US005103843A

United States Patent [19]

Burger et al.

[11] Patent Number: 5,103,843

[45] Date of Patent: Apr. 14, 1992

[54] PROCESS FOR IMPROVING THE TASTE AND AROMA OF TOBACCO

[75] Inventors: Jacobus J. Burger, Amsterdam; Hendrik Willem M. van Drooge, Hilversum; Rudi F. van Eick, Huizen; Harrie Renes, Blaricum, all of Netherlands

[73] Assignee: Naarden International N.V., Rotterdam, Netherlands

[21] Appl. No.: 372,619

[22] Filed: Jun. 28, 1989

[30] Foreign Application Priority Data

Oct. 31, 1988 [EP] European Pat. Off. ..... 88202426.8

[51] Int. Cl.[5] ..... A24B 15/28; A24B 15/30

[52] U.S. Cl. ..... 131/309; 131/308; 131/351; 131/275

[58] Field of Search ..... 131/352, 275, 352, 309, 131/310, 300

[56] References Cited

U.S. PATENT DOCUMENTS 2,158,565 5/1939 Andrews ..... 131/352

4,259,355 3/1981 Marmo et al. ..... 131/275

FOREIGN PATENT DOCUMENTS 0109698 5/1984 European Pat. Off. .

0150077 7/1985 European Pat. Off. .

0185442 6/1986 European Pat. Off. .

0235539 9/1987 European Pat. Off. .

0284790 10/1988 European Pat. Off. .

*Primary Examiner*—V. Millin

*Attorney, Agent, or Firm*—Cushman, Darby & Cushman

[57] ABSTRACT

The invention provides a process for improving the taste and aroma of tobacco by finely dispersing over it an emulsion comprising an emulsifier, an aqueous phase and an oil phase containing at least 10% by weight of a non-volatile oil. The non-volatile oil comprises hydrocarbons, fatty acids, fatty acid esters, fatty alcohols and vegetable waxes, all having between 10 and 40 carbon atoms. The emulsifier is preferably water-soluble or water dispersible. The emulsions may be used as vehicles for applying other water-soluble and/or oil-soluble additives such as flavors, casing, humectants etc.

17 Claims, No Drawings

PROCESS FOR IMPROVING THE TASTE AND AROMA OF TOBACCO

The invention relates to a process for improving the taste and aroma of tobacco.

It is customary in the tobacco industry to improve the organoleptic quality of tobacco products by applying several kinds of additives to the tobacco in different stages of the production process. Thus, casing liquids such as licorice extract, fruit juices or other natural extracts, and humectants such as glycerol and solutions of sugars or sorbitol are sprayed over the tobacco at some stage of the process. Also, water-soluble flavourings are sometimes added. In the final stages of the production process, the tobacco is usually treated with a so-called "top flavouring", which in most cases is sprayed over the tobacco as a solution in some volatile organic solvent such as ethanol or isopropanol, whereafter the solvent is left (or forced) to evaporate. This procedure leads to large amounts of flammable vapours with associated fire and explosion hazards.

The top flavourings, which for an appreciable part consist of volatile flavour components, mainly remain on the outside of the tobacco. Therefore, the quality of a top flavouring is often adversely affected, on the one hand, by evaporation, partly together with the organic solvent, partly on its way from the producer to the consumer, and, on the other hand, by oxidative deterioration.

Several solutions for this problem have been advanced. Thus, encapsulated flavours have been proposed which must be adhered to the tobacco, e.g. as described in U.S. application Nos. 4,617,945 and 4,611,608. In EP-A-0 235 539 it is described how to flavour tobacco with an emulsion of a volatile flavouring in an aqueous solution of a hydrocolloid carrier, such as a microbial or vegetable gum or a starch derivative, and an emulsifier. After drying of the tobacco thus treated, the volatile flavouring left on the tobacco is protected by a thin layer of the hydrocolloid carrier.

These prior art methods only provide a solution for problems associated with the top flavouring but also introduce a substantial quantity of non-tobacco solids which might adversely affect the taste and aroma of the end product.

Moreover, the prior art does not provide a method to combine different kinds of tobacco additives and add them to the tobacco in one step.

Finally, there is a need for processes to improve the organoleptic quality of tobacco, independent of the addition of tobacco flavourings.

It has now been found that the taste and aroma of tobacco can be improved by finely dispersing over the tobacco an emulsion comprising an emulsifier, an aqueous phase and an oil phase containing a non-volatile oil, being an organic substance which is not miscible with water and which, on complete combustion, only yields carbon dioxide and water. The oil should have no undesirable odour or taste, preferably it should be substantially odour- and tasteless. On burning, the oil gives a positive contribution to smoking pleasure by diminishing any harsh or acrid aspects of aroma and taste of the smoke without itself contributing aroma and taste. Suitable oils consist of compounds having between 10 and 40 carbon atoms, preferably between 12 and 30 carbon atoms.

It should be noted that for the purposes of this invention the term "oil" includes substances which are solid at ambient temperatures but melt, and can thus be emulsified, at elevated temperatures, preferably below 100° C. Likewise, the term "emulsion" here includes a mixture which is a true emulsion only at these elevated temperatures but would properly be called a suspension at ambient temperatures.

Suitable oils include hydrocarbons such as liquid paraffin, vaseline and hard paraffin, fatty acids such as stearic acid, fatty acid esters, fatty alcohols such as phytol, and vegetable waxes. The oil phase constitutes not more than 60%, and preferably less than 50% by weight of the total emulsion.

Emulsifiers used in the invention are preferably waster-soluble or water-dispersible. Suitable emulsifiers are e.g. vegetable gums such as gum arabic, talha, ghatti and emulgum, microbial gums, modified starches, fatty acid mono- and diglycerides, fatty acid esters of sorbitol and of saccharides. The quantity of emulsifier used is between 0.05 and 20%, preferably between 0.1 and 10%, of the total emulsion.

An emulsion according to the invention may consist of only water, emulsifier and non-volatile oil and be added in addition to the usual tobacco additives such as flavourings, casings, humectants and the like. However, it may be advantageously used as a vehicle for one or more of these additives. Thus, the aqueous phase may contain water-soluble casing components and/or humectants and/or pH-regulating compounds and/or salts of organic or inorganic acids which are usually added to control the burning properties of tobacco, and/or any other water-soluble component which improves the organoleptic or burning properties of the tobacco. It may further contain water-soluble flavourings such as Maillard-type reaction flavourings, fruit flavourings, honey flavourings and cocoa flavourings and the like.

Likewise, the oil phase may contain oil-soluble tobacco additives such as oil-soluble flavourings, especially top flavourings.

It was found that top flavourings applied as part of emulsions according to the invention at least partly penetrate into the tobacco and are thus protected from adverse influences without the need to add large amounts of non-tobacco solids.

Using an emulsion according to the invention as a vehicle for other tobacco additives obviates the need of adding these additives separately. More specifically, incorporating an oil-soluble flavouring in the oil phase of the emulsion circumvents the use of volatile organic solvents. On the other hand, the emulsions according to the present invention introduce much less non-tobacco solids than prior art methods for adding volatile flavourings.

In order for the non-volatile oils to exert their positive influence on the tobacco aroma and taste as described above, they should constitute at least 10%, and preferably not less than 50% by weight of the oil phase. It is particularly preferred when the non-volatile oil constitutes at least 80% of the oil phase.

The stability of the emulsions according to the invention may be improved by increasing the viscosity, by the addition of conventional thickening agents to the aqueous phase such as carrageenans, pectins, starch derivatives, cellulose derivatives, vegetable gums such as guar, xanthan and karaya. The amount of such thickening agents should not exceed 2% w/w of the aqueous phase and should preferably be limited to 0.5% w/w or less. The stability of the emulsions may also be improved by adding oil-soluble co-emulsifiers to the oil phase, such as ester gum, dammar resin and rosin, in a quantity of at most 60% by weight calculated on the oil phase and preferably not more than 10% w/w.

The emulsions may be made in any conventional way, especially by simply mixing the aqueous phase and the oil phase and subjecting the mixture to high shear forces such as applied in homogenization equipment. Emulsions may also be conveniently prepared using ultrasonic mixing equipment. The emulsification step may be carried out at ambient temperatures. If the non-volatile oil is very viscous or solid at ambient temperature, it may be advantageous to carry out the emulsification step at an elevated temperature which, however, should preferably not exceed 100° C.

The incorporation of tobacco additives in the emulsions as outlined above may be done either before the actual preparation of the emulsion, i.e. water-soluble components may be added to the aqueous part and oil-soluble components added to the non-volatile oil, whereafter the emulsion is prepared or it may be mixed with the emulsion already prepared.

In the latter case, it is sometimes advantageous to repeat the actual emulsification step, i.e. homogenization or ultrasonic mixing or the like, after the tobacco additive has been added to the emulsion already prepared, especially if the tobacco additive is oil-soluble.

Oil-soluble tobacco additives added to an emulsion already prepared, often do not dissolve in the existing oil phase and thus after the second emulsification step an additional oil phase is created in the emulsion. However, for the purposes of this invention these oil phases are together referred to as the oil phase.

The emulsions of the invention may be added to the tobacco in any desired stage of the production process of the tobacco end product. Thus, it may be added to the tobacco leaves or to cut, shredded or otherwise comminuted tobacco. It may also be added to tobacco-derived materials such as stems, reconstituted tobacco or expanded tobacco, or to tobacco substitutes of either natural or synthetic origin. These materials, for the purpose of this invention, are all comprised in the term "tobacco".

Since in many cases the location where the emulsions are prepared will be different from that where they are used, it is often advantageous from an economical point of view to make the emulsions rather concentrated, i.e. to have them contain a relatively low quantity of water. They may then be diluted to the required strength with water or, if desired, with an aqueous solution of other tobacco additives, before dispersion over the tobacco.

Application of the emulsions to tobacco may be done by any suitable means, more particularly by spraying or atomizing the emulsions over a layer of tobacco, either continuously, e.g. by sprayheads mounted over a moving belt holding the tobacco, or batchwise. Any residual water may be removed, if necessary, by allowing the tobacco to dry, aided by application of heat, if so desired.

The quantity of emulsion to be added to the tobacco is not critical, although it is generally impractical to add so much emulsion that afterwards the tobacco has to be subjected to an extensive drying operation in order to remove the excess of water. On the other hand, the quantity of emulsion is dependent on the quantity of non-volatile oil and/or other tobacco additives one wants to add to the tobacco and the concentration thereof in the emulsion. In general it is advisable to limit the amount of emulsion to 20% of the weight of the untreated tobacco. Preferably, the amount of emulsion should not exceed 10%.

Tobacco products such as cigarettes, cigars and cigarillos may be prepared from tobacco processed according to the invention, by any method usual in the tobacco industry.

The invention is illustrated in the following Examples but not in any way limited thereto.

EXAMPLE 1

100 g of liquid paraffin, 25 g of water and 75 g of a 10% w/w aqueous solution of ghatti gum were vigorously shaken and afterwards homogenised 3 times with a hand-operated homogeniser at 10 bar and 3 times at 50 bar. The emulsion obtained remained stable for more than 20 days. 100 g of it was sprayed over 2 kg of shredded reconstituted tobacco, which was thereafter dried at 80° C. to a moisture content of 11% w/w.

Cigarettes made from this tobacco tasted appreciably less harsh on smoking than cigarettes made from the same untreated tobacco.

EXAMPLE 2

A flavoured emulsion for tobacco was prepared by mixing 482 g of water, 300 g of a 10% w/w aqueous solution of gum ghatti, and 4 g of a 25% w/w solution of sodium benzoate, followed by 10 g of a 50% w/w aqueous solution of citric acid and stirring it for 15 min. with an impeller stirrer. Thereafter, stirring was interrupted and 4 g of a 10% w/w solution of an oil-soluble "tobacco enhancer" in ethanol was added, followed by gentle shaking, whereupon the ethanol solvent was taken up by the water layer and the oil-soluble flavouring separated. Thereafter, 200 g of liquid paraffin was added and by gently shaking the flavouring dissolved in the paraffin layer. Stirring was continued for 30 minutes and the resulting pre-emulsion was once run through a Rannie homogeniser at 50 bar and three times at 150 bar. The emulsion obtained (1000 g) remained visually stable for at least 5 months. The emulsion was characterised by an interfacial area of 9.2 $m^2/cm^3$ and a mean volume diameter of $1.5 \pm 1.3$ μm.

The 1000 g of emulsion obtained was sprayed on to 20 kg of shredded low-quality tobacco, which was thereafter dried at 60° C. to a moisture content of 11% w/w.

Another 20 kg of shredded low-quality tobacco of the same lot was sprayed with an alcoholic solution obtained by further diluting 4 g of the tobacco enhancer solution also used in the above-mentioned emulsion with 396 g of ethanol. The tobacco thus sprayed was left to dry for 24 hours.

Cigarettes were made from both tobacco lots. The cigarettes made from the emulsion-treated tobacco had the same basic flavour impression as those made from the tobacco treated with the alcoholic solution but smoother and more balanced.

EXAMPLE 3

Flavoured emulsions for tobacco were prepared as described in Example 2, having, however, different aqueous phases. The differences are outlined in Table I. The emulsions were applied to low-grade tobacco and these tobaccos compared with conventionally treated tobacco, also as described in Example 2. In all cases, the emulsion-treated tobaccos were preferred.

All emulsions were kept in glass bottles for at least 5 months in order to visually evaluate their stability. Most of them did not show any separation for the entire period. Some appeared to separate but could be reconverted into a homogeneous emulsion by inverting the bottle a few times.

TABLE I

| Composition of the aqueous phase (amounts in grams) | | | | | | | Emulsion characteristics | |
|---|---|---|---|---|---|---|---|---|
| | emulsifiers (10% w/w aqueous solution) | | | | thickening agents (1% w/w aqueous solution) | | | |
| water | gum talha | gum arabic | gum ghatti | purity gum* | gum guar | xanthan | Interfacial area ($m^2/cm^3$) | Mean volume diameter ($\mu m$) |
| 486 | 300 | — | — | — | — | — | 2.7 | 4.7 ± 3.1 |
| 486 | — | 300 | — | — | — | — | 3.0 | 3.5 ± 2.4 |
| 361 | — | 300 | — | — | — | 125 | 3.1 | 2.9 ± 1.7 |
| 236 | — | — | 300 | — | 250 | — | 13.5 | 0.6 ± 0.3 |
| 486 | 150 | — | 150 | — | — | — | 11.2 | 0.7 ± 0.3 |
| 361 | 150 | — | 150 | — | — | 125 | 9.5 | 0.9 ± 0.5 |
| 486 | — | 150 | 150 | — | — | — | 6.3 | 1.4 ± 0.8 |
| 361 | — | 150 | 150 | — | — | 125 | 8.9 | 0.9 ± 0.5 |
| 36 | — | — | — | 750 | — | — | 10.3 | 1.3 ± 0.5 |
| 386 | — | — | 150 | — | 250 | — | 8.4 | 1.0 ± 0.6 |
| 136 | — | — | 150 | 500 | — | — | 11.9 | 1.0 ± 0.3 |

*Modified starch emulsifier marketed by National Starch & Chemical Co.

EXAMPLE 4

Flavoured emulsions for tobacco were prepared as described in Example 2, having, however, different oil phases as outlined in Table II. The emulsions were applied to tobacco and tested in comparison with conventionally treated tobacco, also as described in Example 2. In all cases the emulsion-treated tobaccos were preferred.

TABLE II

| Composition of the oil phase (amounts in grams) | | | | | Emulsion characteristics | |
|---|---|---|---|---|---|---|
| | Co-emulsifier (20% soln. in isopropanol)* | | | | | |
| Liquid paraffin | ester gum | dammar resin | rosin | tobacco flavour soln. | Interfacial area ($m^2/cm^3$) | Mean volume diameter ($\mu m$) |
| 171 | 25 | — | — | 4 | 11.8 | 0.6 ± 0.2 |
| 171 | — | 25 | — | 4 | 12.0 | 0.6 ± 0.2 |
| 171 | — | — | 25 | 4 | 11.4 | 0.6 ± 0.2 |

*For reasons of convenience, the co-emulsifiers were first dissolved in isopropanol. Thus, the amounts given consist of 20 g isopropanol and 5 g co-emulsifier.

EXAMPLE 5

A flavoured emulsion for tobacco was prepared by first mixing 1800 g of a 10% w/w aqueous ghatti gum solution, 1500 g of a 1% w/w xanthan gum solution, 20 g of a 25% w/w aqueous sodium benzoate solution, 60 g of a 50% w/w aqueous citric acid solution and 1400 g of water. To this was added 3900 g of a water-soluble tobacco flavouring mixture, comprising a Maillard-type reaction flavouring and an irritation reducer and having a total water content of 63%. The mixture was stirred till homogeneous with an impeller stirrer. Thereafter, 100 g of a 20% w/w solution of a top flavouring in ethanol was added, followed by 1200 g of jojoba oil. After stirring a few minutes, 20 g of a 15% w/w aqueous solution of potassium metabisulphite was added. Stirring was continued for 30 minutes and thereafter the mixture was run four times through a Rannie homogeniser, once at 50 bar and three times at 150 bar.

1 kg of this emulsion was sprayed on to 100 kg of low-grade shredded tobacco consisting of 20% stems, which was dried to 12% water content.

Cigarettes were made from this tobacco which, on smoking, had an agreeable taste and flavour, devoid of any harshness and irritation, normally associated with the use of tobacco stems.

EXAMPLE 6

Emulsions A–D were prepared as described in Example 5:

| | | |
|---|---|---|
| A | Aqueous phase | |
| | Water | 3550 g |
| | Gum arabic 10% soln. | 3000 g |
| | Gum xanthan 1% soln. | 1250 g |
| | Sodium benzoate 25% soln. | 40 g |
| | Citric acid 50% soln. | 100 g |
| | Concentrated processed tobacco flavouring | 30 g |
| | Oil phase | |
| | Liquid paraffin | 2000 g |
| | Oil-soluble tobacco flavouring, 20% soln. in ethanol | 30 g |
| | | 10,000 g |
| B | Aqueous Phase | |
| | Water | 560 g |
| | Gum arabic 10% soln. | 1500 g |
| | Gum ghatti 10% soln. | 1500 g |
| | Glucose 20% soln. | 1100 g |
| | Sodium benzoate 25% soln. | 40 g |
| | Citric acid 50% soln. | 100 g |
| | Aqueous tobacco flavouring (see Ex. 5) | 3900 g |
| | Oil phase | |
| | Vaseline containing 20% w/w isopropanol | 1200 g |
| | Oil-soluble tobacco flavouring, 20% solution in ethanol | 100 g |
| | | 10,000 g |
| C | Aqueous phase | |
| | Water | 240 g |
| | Purity gum 10% soln. | 6000 g |
| | Gum karaya 1% soln. | 1500 g |
| | Sodium benzoate 25% soln. | 30 g |
| | Citric acid 50% soln. | 100 g |
| | Potassium metabisulphite 15% soln. | 30 g |
| | Oil phase | |
| | Phytol | 2000 g |
| | Oil-soluble tobacco flavouring, 20% soln. in ethanol | 100 g |

-continued

| | | |
|---|---|---|
| | | 10,000 g |
| D | Aqueous phase | |
| | Water | 140 g |
| | Gum arabic 10% soln. | 1500 g |
| | Purity gum 10% soln. | 5000 g |
| | Sorbitol 20% soln. | 1200 g |
| | Sodium benzoate 25% soln. | 30 g |
| | Citric acid 50% soln. | 100 g |
| | Potassium metabisulphite 15% soln. | 30 g |
| | Oil phase | |
| | Jojoba oil | 2000 g |
| | | 10,000 g |

EXAMPLE 7

6000 g of emulsion prepared according to recipe D of Example 6 was mixed with 4000 g of the aqueous tobacco flavouring referred to in Example 5, with the aid of a high shear mixer. A stable, flavouring-containing emulsion was obtained.

EXAMPLE 8

9900 g of emulsion prepared according to recipe D of Example 6 was mixed with 100 g of a 20% solution of a oil-soluble tobacco flavouring in ethanol by stirring for 30 minutes. Thereafter, the mixture was homogenised three times in a Rannie homogeniser, once at 50 bar and two times at 150 bar. A stable, flavouring-containing emulsion was obtained.

We claim:

1. Process for improving the taste and aroma of tobacco, wherein an emulsion is finely dispersed over said tobacco, characterized in that the emulsion comprises an emulsifier in an amount between 0.1 and 10% weight of the total emulsion, an aqueous phase and an oil phase containing at least 10% by weight of a substantially odorless and tasteless non-volatile oil selected from the group consisting of one or more hydrocarbons, fatty acids, esters, fatty alcohols and vegetable waxes, all having between 10 and 40 carbon atoms and combinations thereof and wherein said emulsion also comprises a tobacco additive selected from the group consisting of a water-soluble additive, an oil-soluble additive and combinations thereof.

2. Process according to claim 1, characterised in that the oil phase constitutes 60% by weight or less of the emulsion.

3. Process according to claim 2, characterised in that the oil phase contains at least 50% by weight of the substantially odourless and tasteless, non-volatile oil.

4. Process according to claim 3, characterised in that the oil phase contains at least 80% by weight of the non-volatile oil.

5. Process according to claim 1 characterised in that the emulsifier is water-soluble or water-dispersible.

6. Process according to claim 5, characterised in that the oil phase additionally contains at most 60% by weight of an oil-soluble co-emulsifier.

7. Process according to claim 1, characterised in that the water-soluble additives selected from the group consisting of water-soluble tobacco flavourings, casing components, humectants, pH-regulating compounds, salts of organic acids and salts of inorganic acids.

8. Process according to claim 1, characterised in that the aqueous phase additionally contains at most 2% by weight of a thickening agent.

9. Emulsions for improving the taste and aroma of tobacco, characterized in that they comprise an emulsifier in an amount between 0.1 and 10% by weight of the total emulsion, and aqueous phase and an oil phase containing at least 10% by weight of a substantially odorless and tasteless non-volatile oil selected from the group consisting of hydrocarbons, fatty acids, fatty acid esters, fatty alcohols and vegetable waxes, all having between 10 and 40 carbon atoms and combinations thereof and wherein said emulsion also comprises a tobacco additive selected from the group consisting of a water-soluble additive, an oil-soluble additive and combinations thereof.

10. Emulsions according to claim 9, characterised in that the oil phase constitutes 60% by weight or less of the total emulsion.

11. Emulsions according to claim 10, characterised in that the oil phase contains at least 50% by weight of the substantially odourless and tasteless non-volatile oil.

12. Emulsions according to claim 11, characterised in that the oil phase contains at least 80% by weight of the non-volatile oil.

13. Emulsions according to claim 9, characterised in the the emulsifier is water-soluble or water-dispersible.

14. Emulsions according to claim 13, characterised in that the oil phase additionally contains at most 60% by weight of an oil-soluble co-emulsifier.

15. Emulsions according to claim 9, characterised in that the water-soluble additives selected from the group consisting of water-soluble tobacco flavourings, casing components, humectants, pH-regulating compounds, salts of organic acids and salts of inorganic acids.

16. Emulsions according to claim 9, characterised in that the oil-soluble tobacco additives are oil-soluble tobacco flavourings.

17. Emulsions according to claim 9, characterised in that the aqueous phase additionally contains at most 2% by weight of a thickening agent.

* * * * *

UNITED STATES PATENT AND TRADEMARK OFFICE

CERTIFICATE OF CORRECTION

PATENT NO. : 5,103,843

DATED : Apr. 14, 1992

INVENTOR(S) : Jacobus J. BURGER, et al.

It is certified that error appears in the above-identified patent and that said Letters Patent is hereby corrected as shown below:

Column 7, line 43, insert --fatty acid-- before "esters".

Column 8, line 10, insert --are-- before "selected".

Signed and Sealed this

Twenty-fourth Day of August, 1993

Bruce Lehman

*Attest:*

BRUCE LEHMAN

*Attesting Officer*

*Commissioner of Patents and Trademarks*